United States Patent [19]

Kobayashi et al.

[11] Patent Number: 5,008,710

[45] Date of Patent: Apr. 16, 1991

[54] PAPER FEEDER OF A LABEL PRINTER

[75] Inventors: Hitoshi Kobayashi; Akira Takano; Naoharu Narusawa; Yukihiko Tsukada; Hiroshi Sakamoto; Masaki Hirano; Masao Ando, all of Nagano, Japan

[73] Assignees: Nisshinbo Industries, Inc., Tokyo; Nagano Japan Radio Co., Ltd., Nagano, both of Japan

[21] Appl. No.: 516,967

[22] Filed: Apr. 30, 1990

[30] Foreign Application Priority Data

May 26, 1989 [JP] Japan ..... 1-133100
Sep. 7, 1989 [JP] Japan ..... 1-232133

[51] Int. Cl.[5] ..... G03G 21/00
[52] U.S. Cl. ..... 355/202; 101/228
[58] Field of Search ..... 101/181, 228, 66, 288; 226/33, 43; 242/188; 355/202, 309, 310, 271, 311, 295; 156/DIG. 28, DIG. 33

[56] References Cited

U.S. PATENT DOCUMENTS 3,679,300 7/1972 Artelt, Jr. ..... 355/309 X
4,501,224 2/1985 Shibayama et al. ..... 101/66 X
4,712,114 12/1987 Kikuchi ..... 101/66 X
4,717,059 1/1988 Takahashi ..... 226/43 X

FOREIGN PATENT DOCUMENTS 56-5993 2/1981 Japan .

*Primary Examiner*—A. T. Grimley
*Assistant Examiner*—William J. Royer

[57] ABSTRACT

A paper feeder of a label printer makes printing successively on a continuous printing paper on which a multiplicity of label papers are affixed. The paper feeder includes a control device for moving back the continuous printing paper by a length obtained by adding a fixed length capable of continuously making the next printing subsequently to a final printing position of the printing paper upon resumption of the printing operation when the movement of the printing paper is stopped by completion of the printing operation to an adjustment length for settling a printing position and makes printing successively from a fixed position of the label paper upon resumption after the printing operation is stopped. In this case, the adjustment length is set to a sum of a length from the printing start position of the printing paper upon resumption of the printing operation to a label position detection sensor disposed ahead in the backward direction and a length required to cause the printing paper to reach a constant speed upon resumption of the printing operation.

9 Claims, 5 Drawing Sheets

PAPER FEEDER OF A LABEL PRINTER

BACKGROUND OF THE INVENTION

1. Field of the Invention

The present invention relates to a paper feeder of a label printer using an electronic photographic system which makes printing on a continuous printing paper on which a multiplicity of label papers are successively affixed.

2. Description of the Relative Art

There is known a label printer which can make printing successively on a continuous printing paper on which a multiplicity of label papers are successively affixed. When an electronic photographic system is adopted to this kind of label printer, toner attached on the label paper is thermally pressed by a fixing device using a heat roller. Accordingly, when the printing operation is stopped on the way, it is necessary to feed the printing paper forward by a predetermined length until a final printing position passes through the fixing device. Thereafter, when the printing operation is resumed, a process for the printing is made newly so that a blank portion is formed between the final printing position and the next printing start position on the printing paper, resulting in unused portion of the printing paper from the position of the heat roller to the position of the main charger being left blank.

A paper feeder of a non-impact transfer type printer disclosed in Japanese Patent Publication No. 56-5993 comprises a photosensitive drum which is applied with information to be printed, a retractor mechanism which causes the photosensitive drum to be brought into contact with the printing paper or be separated from the printing paper, a control circuit which controls to make equal the rotational speed of the photosensitive drum to the feeding speed of the paper when the photosensitive drum is in contact with the paper, and control means for moving back the printing paper by a predetermined distance in order to make the distance between the transfer completion end and the next transfer start end of the printing paper to a predetermined value when the photosensitive drum is separated from the printing paper, whereby the occurrence of blank printing paper is avoided when the printing is resumed.

In the label printer which makes the printing on the label paper having a fixed length in the longitudinal direction of the printing paper, it is a matter of course that it is necessary to move back the printing paper to a target position to eliminate blank paper and it is further necessary to set the printing resumption position to a predetermined position of the label paper exactly. In addition, since many functional portions including a roller mechanism for moving the paper, a fixing device, a transfer charger and the like are disposed in the traveling path of the printing paper and a length of the paper to be moved back is relatively long, it is very important to control the backward movement of the paper to a target position stably and exactly.

However, in the paper feeder of the non-impact transfer type printer disclosed in the above publication, since it is merely performed that the paper is moved back by a predetermined value in order to eliminate the vain paper, it can not be adopted in the label printer requiring high accuracy, reliability and stability.

SUMMARY OF THE INVENTION

It is an object of the present invention to provide a paper feeder of a label printer which can obtain original continuous printing quality without printed state on a continuous printing paper being interrupted even when printing operation is interrupted on the way while the printing is effected on label papers affixed on a continuous printing paper successively and can eliminate unused portion of the continuous printing paper to avoid blank printing paper and further can control to set a printing position exactly with high accuracy upon resumption of the printing so that high printing quality can be attained.

Further, it is another object of the present invention to provide a paper feeder of a label printer which can effect prevention of wear of a photosensitive drum by a continuous printing paper due to the control and prevention of deterioration of the printing paper by a heat roller and can prevent occurrence of jam such as loosening of paper and paper jam in the backward movement of the printing paper so that the printing paper can be moved back to a target position exactly and stably.

In order to achieve the above objects, the paper feeder 1 of the label printer according to the present invention comprises a main charger 3 for charging a photosensitive drum 2, a printing head 4 for applying printing information, a developer 5 for attaching toner, a transfer charger 6 for transferring the toner on the photosensitive drum 2 to label papers S affixed on a continuous paper R constituting a continuous printing paper P, and a fixing device 7 for fixing the toner by causing the continuous printing paper P to pass through the fixing device 7. The paper feeder 1 of the label printer using the electronic photographic system capable of making printing successively on the label papers S comprises a control device W for moving back the continuous printing paper P by a lenth Lt+Lg where Lt is a fixed length capable of continuously making the next printing subsequently to the final printing position Mf of the printing paper upon resumption of the printing operation when the movement of the printing paper is stopped by completion of the printing operation and Lg is an adjustment length for settling a print start position. In this case, the fixed length Lt is a length corresponding to a distance between a printing position Mn for printing subsequently to the final printing position Mf on the printing paper P passing through the fixing device 7 and the position of the printing head 4, and the adjustment length Lg is a length obtained by adding a length Ls from the printing start position of the printing paper P upon resumption of the printing operation to a label position detection sensor 10 disposed ahead in the backward direction to a length Lh required until the moving speed of the printing paper P reaches a fixed speed upon resumption of the printing operation. On the other hand, drive roller mechanism 11*a* and 11*b* are disposed ahead in the backward direction to rotate in the reverse direction upon the backward movement so that the printing paper P is moved back. Thus, the backward speed of the printing paper P is set to a lower speed (for example, about $\frac{1}{2}$ to $\frac{1}{3}$) than the printing speed. Further, the fixing device 7 is provided with a fixer displacement mechansim 14 for separating heat rollers 12 and 13 from the printing paper P upon the backward movement. In this case, the fixer displacement mechanism 14 displaces one of the pair of heat rollers 12 and 13 and the pair of heat rollers 12 and 13 are disposed so that both of the heat rollers 12 and 13 are separated from the printing paper P when one of the heat rollers is displaced. Further, a guide mechanism 15 which separates the printing paper P from the photosensitive drum 2 in the backward movement is provided in a transfer charger displacement mechanism 16 which separates the transfer charger 6 from the photosensitive drum 2.

When the movement of the continuous printing paper P is stopped, the printing paper P is moved back by a length of the fixed length Lt plus the adjustment length Lg. In this case, while the length for the backward movement is relatively long, the printing paper is moved back to the target position stably and exactly and the printing start position is set exactly upon resumption of the printing operation.

DETAILED DESCRIPTION OF THE PREFERRED EMBODIMENTS

A preferred embodiment of the present invention is now described with reference to drawings.

Figure 9:
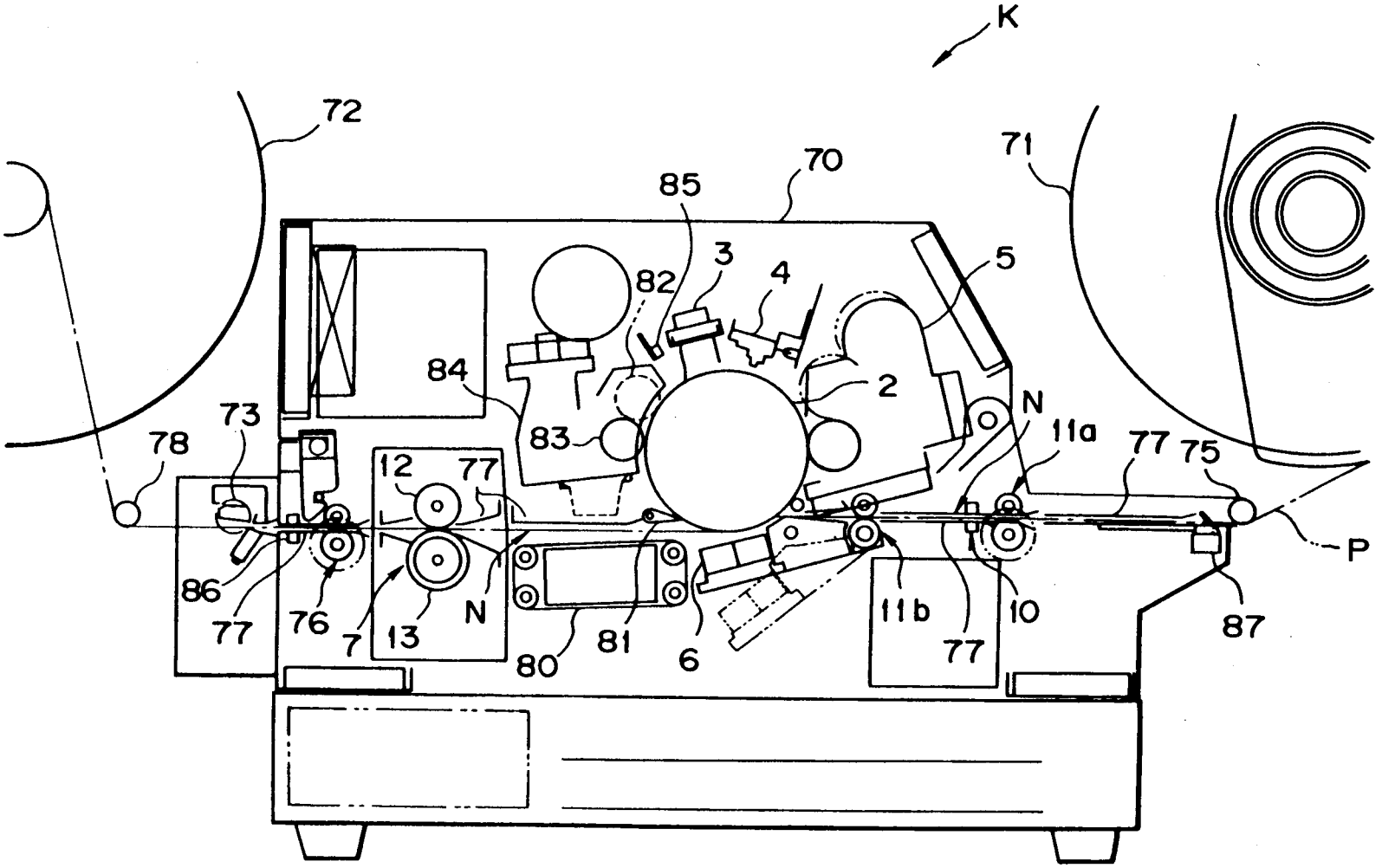
FIG. 9 is a front view schematically illustrating the label printer.

In order to facilitate understanding of the present invention, the whole configuration of the label printer K using an electronic photographic system is described with reference to FIG. 9.

A machine body 70 is provided with a supply reel 71 and a take-up reel 72 mounted to reel shafts disposed in front and rear ends of the machine body 70. The take-up reel 72 and a cutter 73 can be provided selectively. On the other hand, a photosensitive drum 2 is disposed in the middle of the machine body 70. A continuous printing paper P supplied from the supply reel 71 is wound on a take-up reel 72 through a traveling path N consisting of a guide post 75, a plurality of drive roller mechanisms 11*a*, 11*b* and 76 each including a pair of drive roller and driven roller, a plurality of guide plates 77, a guide post 78 and the like. In this case, the printing paper P comes into contact with the periphery of the photosensitive drum 2.

Further, a transfer charger 6 is disposed opposite to the photosensitive drum 2 in the traveling path N. Disposed in the traveling path N near the take-up reel between the photosensitive drum 2 and the take-up reel are a suction device 80 utilizing a belt which sucks the printing paper P fed from the photosensitive drum 2 by a negative pressure so as to take out the printing paper P stably and a fixing device 7 which fixes the toner attached on the printing paper P guided by the suction device 80 by means of a pair of heat rollers 12 and 13.

On the other hand, disposed successively around the photosensitive drum 2 before the transfer in opposing relationship thereto are a main charger 3 which charges the photosensitive drum 2, a printing head 4 which applies information such as figures and characters to be transferred to the photosensitive drum 2 and a developer 5 which attached the toner to the information portion of the photosensitive drum 2. Disposed successively around the photosensitive drum 2 after the transfer in opposing relationship thereto are a peel-off nail 81 which peels off the printing paper P from the photosensitive drum 2, a cleaner (toner collector) 84 including a blade 82 and a magnetic roller 83 and an eraser 85 which erases charges on the photosensitive drum 2. Numerals 10 and 86 denote label position detection sensors which detect an edge of the label paper and numeral 87 denotes a paper sensor which detect the presence of the printing paper P.

Accordingly, the photosensitive drum 2 is charged by the main charger 3 and is applied with the printing information by the printing head 4. Then, the photosensitive drum 2 is attached with the toner by the developer 5. The toner is transferred to the label paper S of the printing paper P from the photosensitive drum 2 by the transfer charger 6 and the printing paper P passes through the fixing device 7 to fix the toner on the label paper S.

The configuration of the paper feeder 1 according to the present invention is described with reference to FIGS. 1 to 8.

First, the configuration of a controller for the paper feeder 1 is described with reference to FIG. 1.

Figure 1:
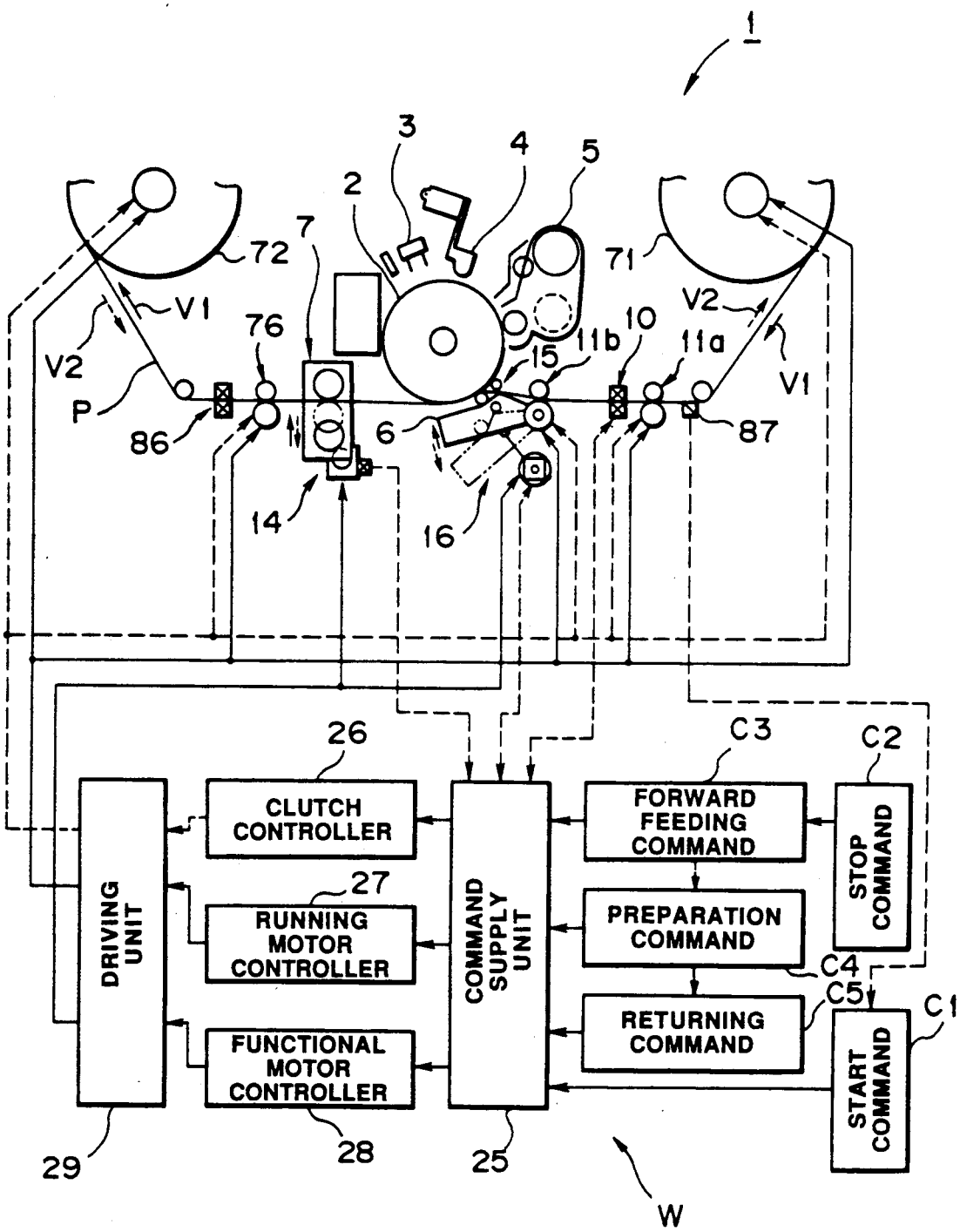
FIG. 1 is a block diagram schematically illustrating a main portion of a paper feeder of a label printer according to the present invention.

As shown in FIG. 1, each of drive axes for a plurality of roller mechanisms 11*a*, 11*b* and 76 which moves the printing paper P and reel axes for the supply reel 71 and the take-up reel 72 is provided with an electromagnetic clutch not shown. Thus, the electromagnetic clutches can be turned on and off so that the movement of the printing paper P can be switched in the direction of printing movement (forward direction) and in the backward direction.

Further, a controller W includes the function of generating commands such as a start command C1 for starting the printing operation, a stop command C2 for stopping the printing operation, a forward command C3, a preparation command C4, a return or backward movement command C5 and the like and comprises a command supply unit 25, a clutch controller 26, a running or moving motor controller 27, a functional motor controller 28 and a driving circuit 29. Functions of each portion of the controller W will be described later.

Figure 3:
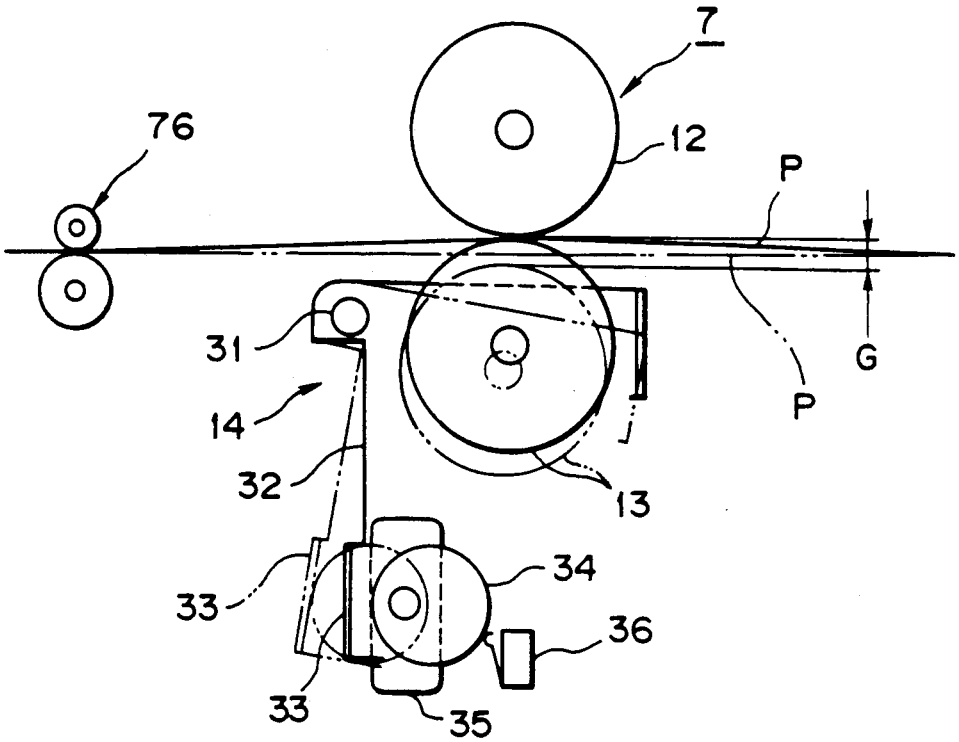
FIG. 3 schematically illustrates a fixing device used in the paper feeder of the label printer of FIG. 1.

On the other hand, a fixing device 7 suitable for use in the paper feeder 1 is configured as shown in FIG. 3. The fixing device 7 includes a pair of heat rollers 12 and 13, and one heat roller 12 thereof constitutes a drive roller which is fixedly mounted to the machine body 70. The heat roller 12 is a hollow roller made of, for example, aluminum and in which a lamp heater is provided. Further, the other heat roller 13 is supported by a fixer displacement mechanism 14 and constitutes a driven roller which is moved forward and backward with respect to the heat roller 12. The fixer displacement mechanism 14 includes a movable plate 32 which is swingably supported by a shaft 31. The heat roller 13 is mounted to the movable plate 32 which is urged to be moved to the heat roller 12 by a spring or the like. The heat roller 13 can be formed of a hollow roller made of, for example, aluminum and an outer periphery of which is covered with silicone rubber and in which a lamp heater is disposed. An engagement member 33 is integrally formed in the movable plate 32 and is operated to or abutted against an eccentric cam 34 which is rotated by a drive portion 35. Numeral 36 denotes a limit switch which detects the position of the eccentric cam 34. Thus, the movable plate 32 can be swingably displaced over a predetermined angular range so that the heat roller 13 can be pressed onto or separated from the heat roller 12. In this case, when the heat roller 13 is separated from the heat roller 12, a gap G is produced between the heat rollers 12 and 13 and the disposition of the heat rollers 12 and 13 (or the relative disposition of the drive roller mechanism 76) is selected so that the printing paper P is positioned intermediate of the gap G.

Figure 4:
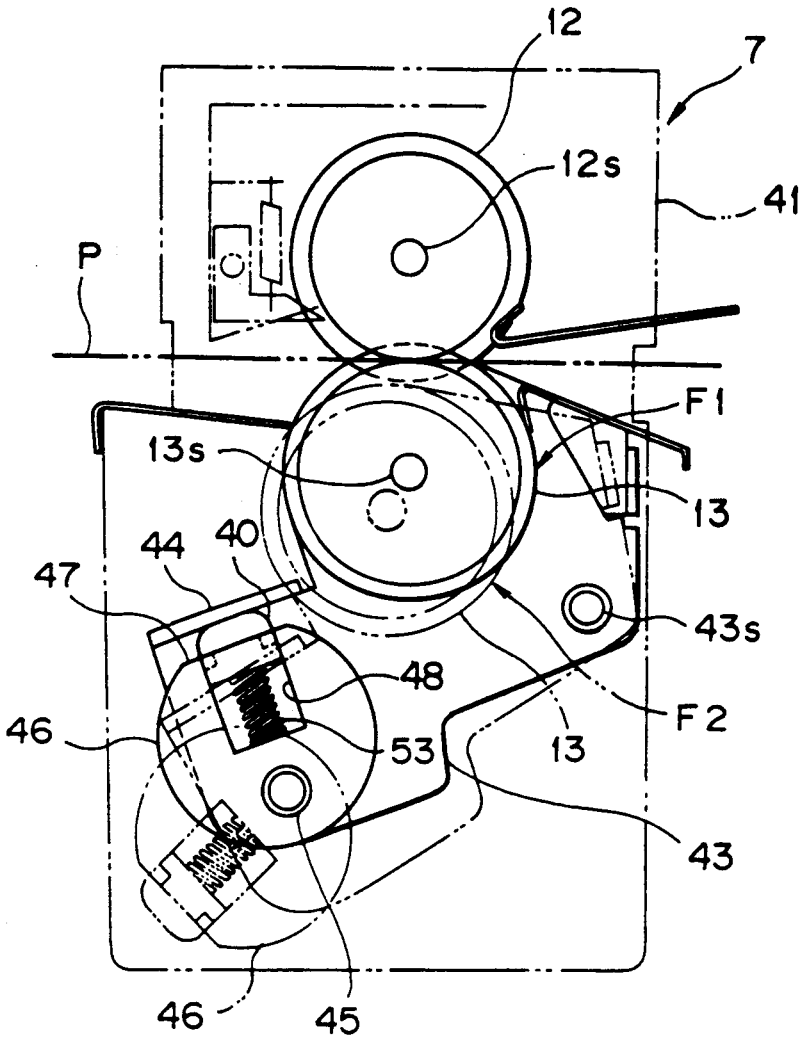
FIG. 4 schematically illustrates a fixing device according to another embodiment used in the paper feeder of the label printer of FIG. 1.
Figure 5:
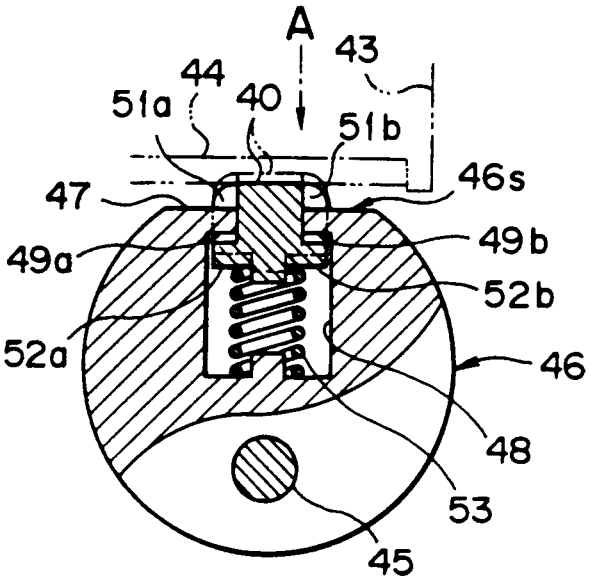
FIG. 5 is a partially sectional view of a eccentric cam of the fixing device.
Figure 6:
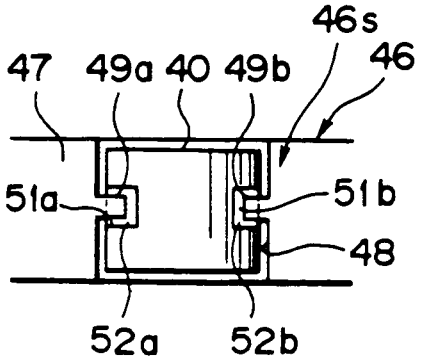
FIG. 6 is a sectional view as viewed from arrow A of FIG. 5.

The fixing device 7 may by structured as shown by another embodiment of FIGS. 4 to 6.

As shown in FIG. 4, the heat roller 12 is rotatably mounted through a horizontal axis 12*s* to a stationary frame 41 disposed in the normal direction.

On the other hand, a movable frame 43 is rotatably mounted through a horizontal axis 43*a* in the stationary frame 41 positioned under the heat roller 12 and the heat roller 13 is rotatably supported to the movable frame 43 through an axis 13*s*. The heat roller 13 is disposed under the heat roller 12 so that the heat roller 13 can abut against the heat roller 12, while in the natural state the movable frame 43 is angularly moved and displaced by its own weight about the axis 43*s* so that the heat roller 13 is separated from the heat roller 12.

One end of the movable frame 43 is bent at a right angle thereto to form therein an engagement piece 44. Further, a rotation drive portion not shown is provided on the side of the stationary frame 41 (on this side of the drawing) and an eccentric cam 46 of which rotation is controlled by a rotary shaft 45 of the rotation drive portion is disposed so that the periphery of the cam 46 can abut against the engagement piece 44.

As shown in FIGS. 5 and 6, the eccentric cam 46 has a predetermined thickness and is formed with a D cut plane 47 formed in a peripheral portion 46*s* separated farthest from the rotary shaft 45. A cavity or hollow container 48 is formed in substantially the middle of the D cut plane 47 and a pair of opposed stoppers 49*a* and 49*b* are integrally formed on open edges of the container 48 so that the stoppers are protruded toward each other. Further, a pushed portion 40 having a round end is slidably disposed in the container 48. In this case, the pushed portion 40 is formed with slits 51*a* and 51*b* formed over a predetermined length from an upper end to a lower end of the pushed portion 40 and through which the stopper 49*a* and 49*b* pass. Thus, the stopper 49*a* and 49*b* are engaged with engagement portions 52*a* and 52*b* formed on the lower end of the pushed portion 40 so that the pushed portion 40 is prevented from going out from the container 48 and the pushed portion 40 is guuided by the stoppers 49*a* and 49*b*. A compression coil spring 53 is disposed in the container 48 so that the upper end of the pushed portion 40 can be protruded from the D cut plane 47 (peripheral portion 46*s*) by a predetermined length in the natural state and the pushed portion 40 can be pushed into the container 48 against the resilience of the coil spring 53.

Accordingly, in the printing operation, the eccentric cam 46 is displaced to the position shown by the solid line in FIG. 4. Thus, the eccentric cam 46 pushes up the engagement piece 44 and is stopped in the state in which the upper end of the pushed portion 40 abuts against the engagement piece 44. More particularly, in this state, the pushed portion 40 is slightly pushed into the container 48 and accordingly the heat roller 13 is moved to a set position (pressurizing position F1) shown by a solid line. Thus, the heat roller 13 is urged to abut against the heat roller 12 by the coil spring 53 to exhibit the ordinary toner fixing function. On the other hand, when the eccentric cam 46 is rotated, the engagement piece 44 of the movable frame 43 is displaced downward by its own weight while the engagement piece 44 is put on the eccentric cam 46. The eccentric cam 46 is stopped to be rotated 180° and in this state the engagement of the eccentric cam 46 and the engagement piece 44 is released. The movable frame 43 is engaged with a stopper not shown in a position shown by phantom line and the heat roller 13 is positioned in a release position (release position F2) shown by phantom line so that the heat rollers 12 and 13 are maintained to be separated from each other. Even in this case, the continuous printing paper P is positioned so that the printing paper P does not come into contact with both of the heat rollers 12 and 13.

Figure 7:
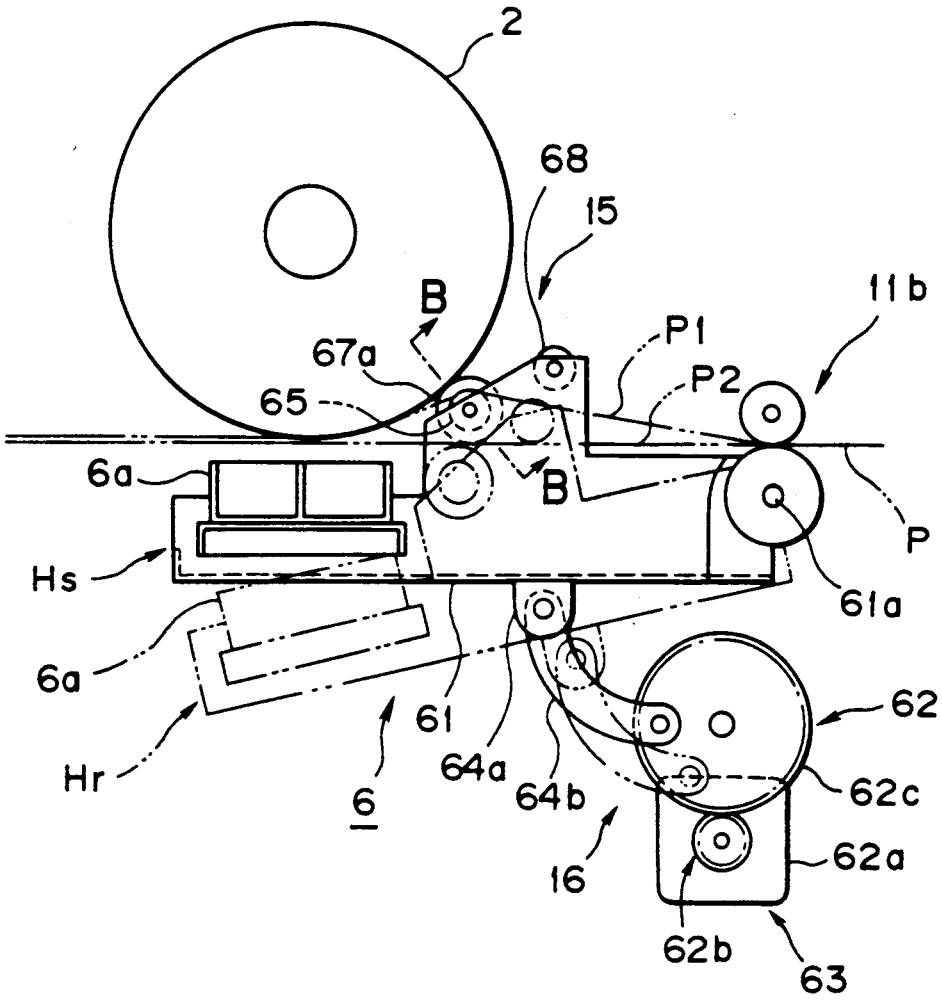
FIG. 7 schematically illustrates a transfer charger used in the paper feeder of the label printer.
Figure 8:
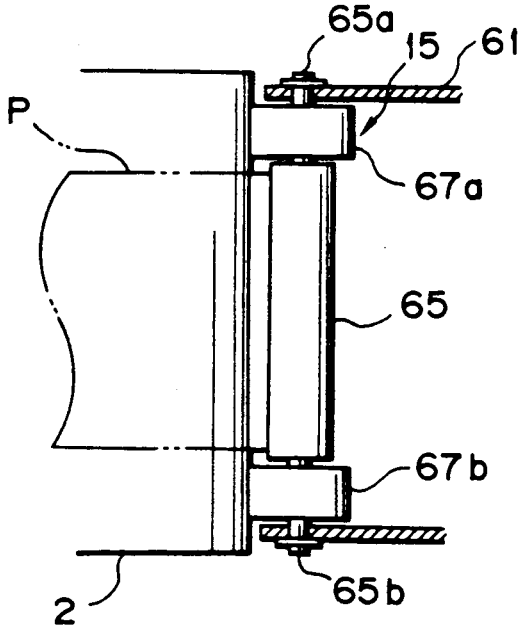
FIG. 8 is a partially sectional view taken along line B—B of FIG. 7.

The transfer charger 6 suitable for use in the paper feeder 1 is structured as shown in FIGS. 7 and 8. The transfer charger 6 includes a transfer charger body 6*a* and a transfer charger displacement mechanism 16 which supports the body 6*a*. The displacement mechanism 16 includes a movable arm 61 having a rotary fulcrum 61A disposed at one end as shown in FIG. 7 and the body 6*a* is mounted to the other end of the movable arm 61. The movable arm 61 is driven by a drive portion 62 to cause the body 6*a* to approach the photosensitive drum 2 so that the movable arm 61 is selectively moved to a set position Hs in which the function thereof is exhibited and to a release position Hr in which the movable arm 61 is separated from the photosensitive drum 2.

The drive portion 62 comprises a drive unit 63 including a motor 62*a* and a gear mechanism 62*b* and an eccentric position of an output gear 62*c* of the drive unit 63 is rotatably coupled through a link 64*b* to a bracket 64*a* disposed behind the movable arm 61. Thus, when a rotating angle of the motor 62*a* is controlled, the body 6?*a* of the transfer charger can be selectively moved to the set position Hs or the release position Hr.

On the other hand, the movable arm 61 is formed into a U-letter shape in section and the arm is disposed so that an opening thereof is opposed to the photosensitive drum 2. A guide mechanism 15 is disposed in the middle of the movable arm 61. The guide mechanism 15 is provided with a first guide roller 65 which guides the continuous printing paper P and position restriction rollers 67*a* and 67*b* are rotatably supported to shaft portions 65*a* and 65*b* formed integrally at both sides of the first guide roller 65. Further, ends of the shaft portions 65*a* and 65*b* are rotatably supported to the movable arm 61 as shown in FIG. 8. Consequently, the first guide roller 65, the position restriction rollers 67*a* and 67*b* can be rotated with regard to the movable arm 61. The position restriction rollers 67*a* and 67*b* have a diameter larger than that of the first guide roller 65. Thus, the printing paper P is moved smoothly by the first guide roller 65 and is brought into contact with the photosensitive drum 2 stably. Further, since the position restriction rollers 67*a* and 67*b* can be rotated while the restriction rollers come into contact with and follow the periphery of the photosensitive drum 2, the rollers 67*a* and 67*b* can restrict the relative position of the movable arm 61 and the photosensitive drum 2. In this case, since the body 6*a* of the transfer charger always follows the periphery of the photosensitive drum 2, the distance between the body 6*a* and the photosensitive drum 2 is always constant. Further, a second guide roller 68 is disposed in the middle of the movable arm 61 and in the opposite side of the body 6*a*, as viewed from the printing paper P. The positional relation of the movable arm 61 and each portion of the guide mechanism 15 in the transfer charger 6 is as follows.

First, in the printing operation in which the movable arm 61 is positioned in the set position Hs, the printing paper P is guided by the drive roller mechanism 11*b*, the first guide roller 65 and the photosensitive roller 2 as shown by P1 of FIG. 7 and is not in contact with the second guide roller 68. On the other hand, when the movable arm 61 is positioned in the release position Hr, the first guide roller 65 and the second guide roller 68 are both moved back by the backdown of the movable arm 61 to engage the second guide roller 68 with the printing paper P so that the printing paper P is separated from the periphery of the photosensitive drum 2 as shown by P2 of FIG. 7.

In this manner, the guide mechanism 15 is provided in the movable arm 61 so that the printing paper P can be separated from the photosensitive drum 2 without deteriorating the positional accuracy of the transfer charger body 6*a*.

Operation of the paper feeder 1 according to the present invention is now described with reference to FIGS. 1 and 2.

First, the start command C1 is produced from the controller W in the printing operation and is supplied through the command supply unit 25 to the clutch controller 26, the running motor controller 27, the fixing device 27 and the functional motor controller 28 of the transfer charger 6. Thus, the drive unit 29 is driven to set each portion to the printing operation state. That is, the electromagnetic clutch of the take-up reel 7 can be turned on to wind the printing paper P and the electromagnetic clutches for the drive roller mechanisms 11*a*, 11*b* and 76 are turned on the rotated in the normal direction. Further, the heat roller 13 of the fixing device 7 is pressed against the heat roller 12 by the fixer displacement mechanism 14 and becomes the state in which the fixing operation can be made. The movable arm 61 of the transfer charger displacement mechanism 16 in the transfer charger 6 is rotated clockwise so that the printing paper P is brought into contact with the photosensitive drum 2 to set the state in which the transfer operation can be made. The electromagnetic clutch of the supply reel 71 is turned off but applies a predetermined back tension to the printing paper P.

Accordingly, in the printing operation, the printing paper P is moved in the direction of arrow V1 and is wound on the take-up reel 72.

Figure 2:
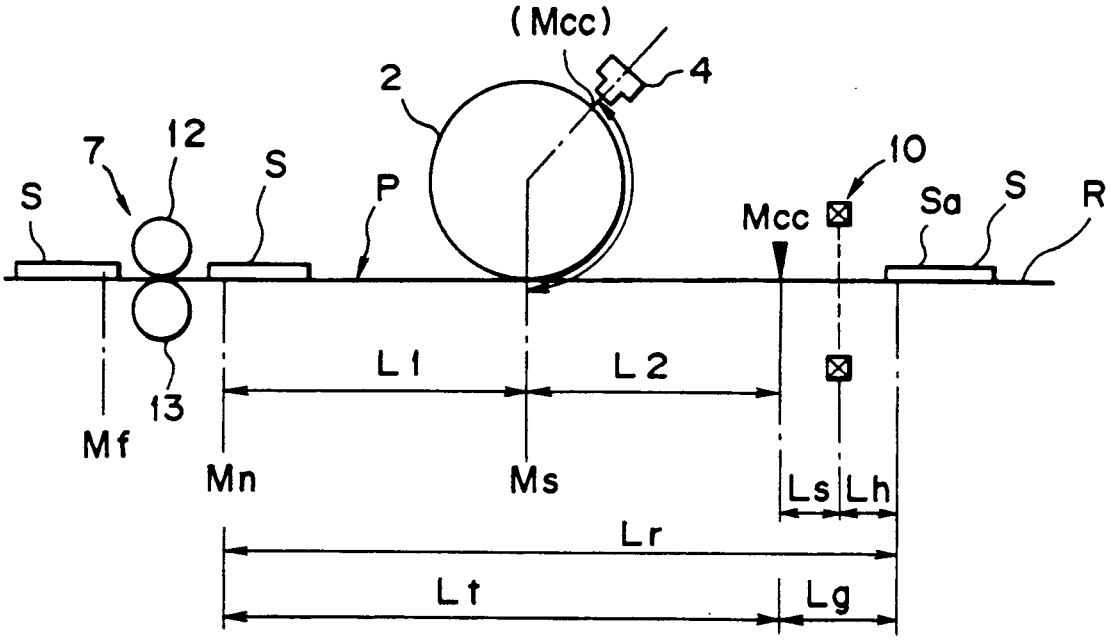
FIG. 2 is a diagram for explaining the backward movement of a continuous printer paper in the paper feeder of the label printer of FIG. 1.

On the other hand, when the printing operation is stopped (interrupted) on the way, the stop command C2 is produced and the forward command C3 is produced to move the printing paper P forward until the final printing position Mf passes through the heat rollers 12 and 13 as shown in FIG. 2. An amount of forward movement according to the forward command C3 is set on the basis of the distance between the transfer charger 6 and the fixing device 7.

If the forward movement of the printing paper P has been completed and the movement of the printing paper P is stopped, the printing paper P is moved back io the direction of arrow V2. In the backward movement, the heat roller 13 is separated from the heat roller 12 in the fixer displacement mechanism 14 in response to the preparation commnand C4. Consequently, the printing paper P is separated from both of the heat rollers 12 and 13. Thus, burning and deterioration of the printing paper P due to heat (about 150° to 190° C.) left in the heat rollers are prevented. Further, the transfer charger displacement mechanism 16 in the transfer charger 6 is angularly moved counterclockwise in response to the preparation command C4 so that the printing paper P is separated from the photosensitive drum 2. Thus, wearing of the photosensitive drum 2 by the printing paper P in the backward movement is avoided. The completion of the above processing of the fixing device 7 and the transfer charger 6 is detected by the limit switch 36 or the rational angle of the motor 62*a* and the return command C5 is produced. Consequently, the electromagnetic clutch of the supply reel 71 is turned on so that the reverse rotation is controlled and further the electromagnetic clutch of the take-up reel 72 is turned off. At this time, the two sets of drive roller mechanism 11*a* and 11*b* disposed between the photosensitive drum 2 and the supply reel are rotated reversely for the backward movement while the electromagnetic clutches are on, while the drive roller mechanism 76 disposed behind the fixing device 7 is served as an idler by turning off the electromagnetic clutch. The movement of the suction device 80 is stopped.

The feeding speed of the backward movement is set to a speed lower than that in the printing operation. The speed of the backward movement depends on the tensile strength for the printing paper P but is preferably set to a speed as large as a half or one third of the speed in the printing operation. The reason why the speed of the backward movement is low is that since the printing paper P is released from being held between the heat rollers 12 and 13 of the fixing device 7 and from being pressed to the photosensitive drum 2, the moving resistance is made small and accordingly the printing paper P becomes loose so that a jam occurs easily if the speed of the backward movement is high. The speed of the backward movement is provided in the command value of the return command C5.

Further, the length for the backward movement is set to the length of the fixed length Lt capable of making printing continuously subsequently to the final printing position Mf of the printing paper P plus the adjustment length Lg for settling the printing position. That is, the fixed length Lt is equal to a sum (L1+L2) of the length L1 from the printing position Mn for continuous printing subsequently to the final printing position Mf to the transfer position Ms in the photosensitive drum 2 and the length L2 from the position Ms to the position Mcc immediately after the printing head 4. The adjustment length Lg is set so that the printing paper P which has been moved back is not deviated from the printing start position in the resumption of the next printing operation. The adjustment length Lg is equal to a sum of the length Ls for setting the printing position and the length Lh for compensation upon start. The length Ls is equal to a distance between the position Mcc corresponding to the printing position on the printing paper P upon the resumption of printing and the label position detection sensor 10 for detecting the edge of the label paper. The length Lh is equal to a distance between the label position detection sensor 10 and the leading edge of the label paper S on which the printing is first made upon the resumption of the printing operation. Accordingly, upon the resumption of the printing operation, a transient acceleration upon the start is absorbed in the forward movement for the length Lh and the speed of the forward movement is constant when passing through the label position detection sensor 10. The leading edge of the label paper P is detected by the label position detection sensor 10 and accordingly the normal printing position Mcc on the label paper S is set by the timer in the movement of the length Ls. Thus, the exact printing position is settled by setting the length Lg. The actual backward length Lr, the adjustment feeding command and the stop command are provided in the return command C5 and each of the distances can be set using the timers on the basis of the time and speed.

As described above, the embodiment of the present invention has been described, although the paper feeder of the label printer according to the present invention is not limited the embodiment and can be modified in detailed configuration and operation without departing from the spirit of the present invention.

We claim:

1. A paper feeder of a label printer using an electronic photographic system including a main charger for charging a photosensitive drum, a printing head for applying printing information, a developer for attaching toner, a transfer charger for transferring the toner on the photosensitive drum to label papers affixed on a continuous paper constituting a continuous printing paper and a fixing device for fixing the toner by causing the continuous printing paper to pass through the fixing device, and capable of making printing successively on the label papers, comprising a control device for moving back the continuous printing paper by a length obtained by adding a fixed length capable of continuously making the next printing subsequently to a final printing position of the printing paper upon resumption of the printing operation when the movement of the printing paper is stopped by completion of the printing operation to an adjustment length for settling a printing position.

2. A paper feeder of a label printer according to claim 1, wherein said fixed length is equal to a length between the position for printing subsequently to the final printing position in respect to the printing paper passing through the fixing device and the position of the printing head.

3. A paper feeder of a label printer according to claim 1, wherein the adjustment length is equal to a sum of a length from the printing start position of the printing paper upon resumption of the printing operation to a label position detection sensor disposed ahead in the backward direction and a length required to cause the printing paper to reach a constant speed upon resumption of the printing operation.

4. A paper feeder of a label printer according to claim 1, comprising a drive roller mechanism disposed ahead in the backward direction to be rotated reversely so that the printing paper is moved back.

5. A paper feeder of a label printer according to claim 1, wherein a speed of the backward movement of the printing paper is set to a speed lower than that in the printing operation.

6. A paper feeder of a label printer according to claim 1, wherein the fixing device includes a fixer displacement mechanism for separating a heat roller from the printing paper upon the backward movement.

7. A paper feeder of a label printer according to claim 6, wherein the fixing device includes a fixer displacement mechanism for displacing one of a pair of heat rollers and the heat rollers are disposed to be separated from the printing paper when one of the pair of heat rollers is displaced.

8. A paper feeder of a label printer according to claim 1, comprising a guide mechanism for separating the printing paper from the photosensitive drum upon the backward movement.

9. A paper feeder of a label printer according to claim 8, wherein the transfer charger includes a transfer charger displacement mechanism for separating the printing paper from the photosensitive drum upon the backward movement and said guide mechanism is provided in the transfer charger displacement mechanism.

* * * * *